United States Patent [19]

Blizzard, Jr.

[11] Patent Number: 5,029,646

[45] Date of Patent: Jul. 9, 1991

[54] ORIFICE WELL SAFETY VALVE WITH RELEASE MECHANISM

[75] Inventor: William A. Blizzard, Jr., Houston, Tex.

[73] Assignee: Camco International Inc., Houston, Tex.

[21] Appl. No.: 550,936

[22] Filed: Jul. 11, 1990

[51] Int. Cl.[5] ..... E21B 34/10

[52] U.S. Cl. ..... 166/323; 166/334

[58] Field of Search ..... 166/319, 320, 321, 322, 166/323, 332, 334

[56] References Cited

U.S. PATENT DOCUMENTS 3,070,119 12/1962 Raulins ..... 137/460
4,129,184 12/1978 Parker ..... 166/323 X
4,362,214 12/1982 Pringle et al. ..... 166/322
4,664,195 5/1987 Deaton ..... 166/323
4,691,779 9/1987 McMahan et al. ..... 166/321

*Primary Examiner*—William P. Neuder
*Attorney, Agent, or Firm*—Fulbright & Jaworski

[57] ABSTRACT

A well safety valve having a flow tube telescopically controlling the movement of a valve element. A coil spring yieldably moves the tube in a direction for opening the valve and a choke bean is connected to the flow tube for controlling the closure of the valve. A spring-loaded release latch engages the flow tube yieldably preventing the flow tube from moving to the closed position. The latch is adjustable and includes a belleville spring for providing a large restraining force without undue deflection.

5 Claims, 2 Drawing Sheets

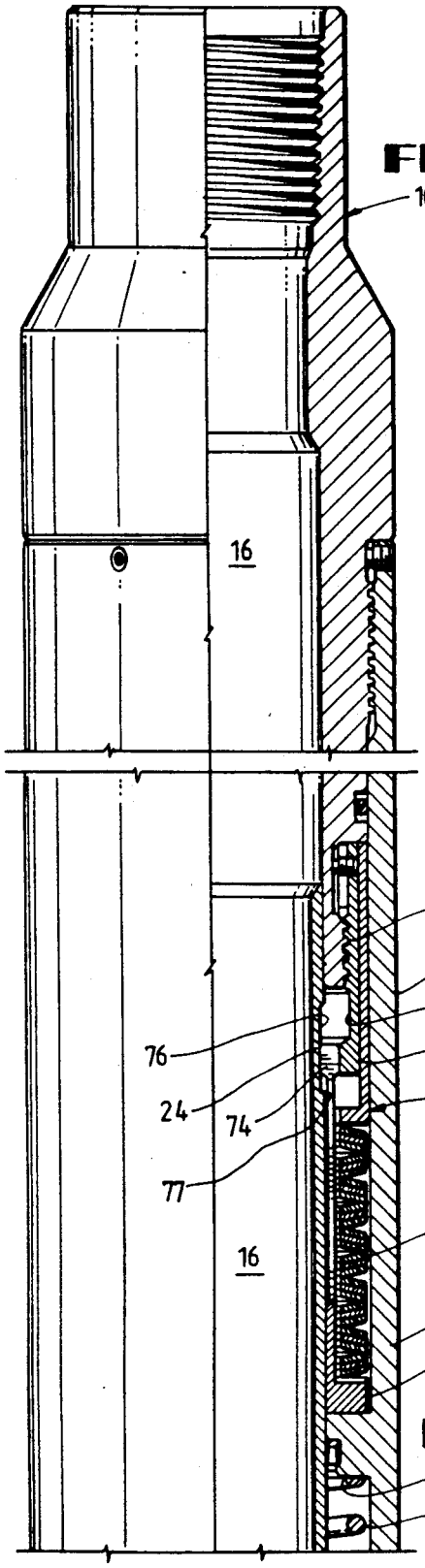
FIG.1A
FIG.1B
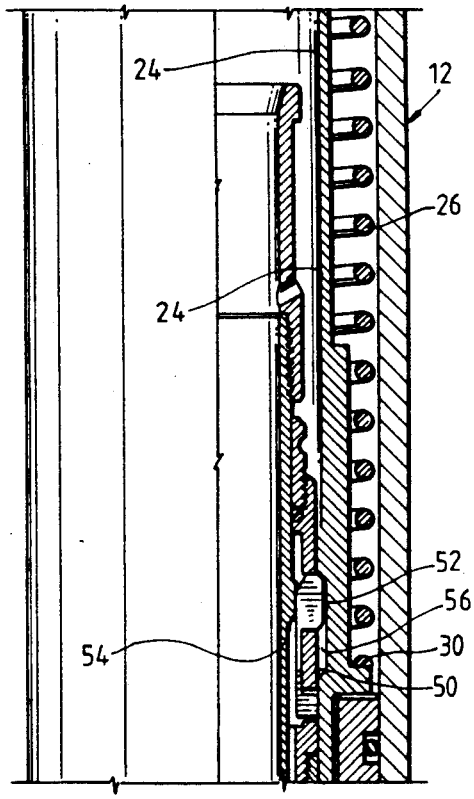
FIG.1C

ORIFICE WELL SAFETY VALVE WITH RELEASE MECHANISM

BACKGROUND OF THE INVENTION

It is known, as disclosed in U.S. Pat. No. 4,362,214, to provide an orifice well safety valve which will close when the differential pressure caused by the flow through a reduced inside diameter choke bean reaches a predetermined level. Such valves can be adjusted to close at different flow rates by changing the spring values which serve to hold the valve open, and/or varying the internal diameter of the choke bean.

However, in some cases, the choke bean may have a large area on which the differential pressure acts, such as the case in using a wireline insertable and removable choke bean. The larger area subsequently causes a larger restraining force to be required to keep the valve open during normal flow conditions. The magnitude of the forces required cannot be conveniently generated by a coiled compression spring commonly used in orifice-type valves.

The present orifice safety valve utilizes a spring-loaded releasable latch which engages the flow tube yieldably preventing the flow tube from moving to the closed position. The spring-loaded releasable latch provides the necessary force by utilizing belleville spring washers which, while having limited deflection characteristics, will provide the large force required to keep a large area orifice valve in the open position. Preferably, the releasable latch is adjustable to change the force setting which the releasable latch exerts on the flow tube.

SUMMARY

The present invention is directed to an orifice well safety valve which includes a housing having a bore therethrough, and a valve element connected to the housing and movable between open and closed positions in the bore. A flow tube is telescopically movable in the housing for controlling the movement of the valve element. Coil spring means is positioned between the housing and the flow tube for yieldably moving the tube in a direction for opening the valve, and a choke bean is connected to the flow tube for closing the valve when the differential pressure caused by the flow through the choke bean reaches a predetermined level. A releasable latch means is provided in the housing and engages the flow tube for yieldably preventing the flow tube from moving to the closed position.

A still further object of the present invention is wherein the releasable latch is adjustable for changing the force exerted on the flow tube.

Still a further object of the present invention is wherein the spring-loaded releasable latch includes a belleville spring acting on the latch in a direction yieldably opposing the movement of the tube in a direction for closing the valve. The belleville spring provides a sufficiently large restraining force, operable with limited defection, in the release mechanism. This latch will retain the flow tube in an open position until a predetermined differential pressure thereafter allowing free movement of the flow tube.

A further object of the present invention is wherein the releasable latch includes a collet movable into and out of a groove in the exterior of the flow tube in which the collet is engageable by a belleville spring. A shoulder in the housing holds the collet head in the groove by the spring when the valve is in the open position. The position of the shoulder is longitudinally adjustable for determining the release of the collet.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIGS. 1A, 1B, 1C, 1D and 1E are continuations of each other and are fragmentary, quarter section views of the safety valve of the present invention shown in the open position.

DESCRIPTION OF THE PREFERRED EMBODIMENT

While the present invention will be described in connection with a tubing retrievable flapper-type orifice safety valve with a wireline retrievable and insertable choke bean, for purposes of illustration, the release mechanism of the present invention may be used with other types of orifice safety valves.

Figure 1D:
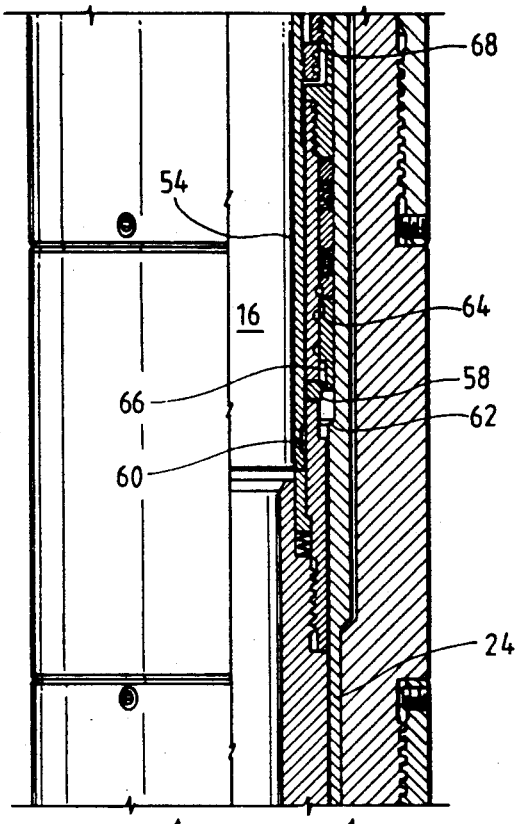
Figure 1E:
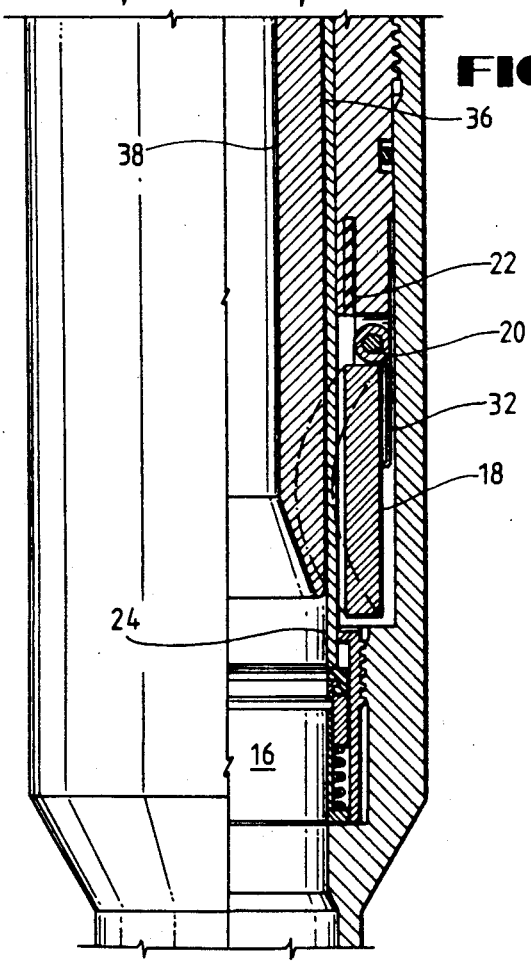

Referring now to the drawings, and particularly to FIGS. 1A–1E, the reference numeral 10 indicates the tubing retrievable safety valve of the present invention which includes a housing 12 adapted to have threaded connections at each end (not shown) for connecting the valve 10 in a well tubing.

Any suitable type of valve element, such as arcuate flapper valve element 18 (FIG. 1E) is provided connected to the housing 12 on a pivot pin 20, which is movable from an open position as shown, to a closed position seated on a valve seat 22 for blocking flow upwardly through the valve 10 through the valve bore 16. A flow tube 24 (FIG. 1B–1E) is telescopically and longitudinally movable in the housing 12 for controlling the opening and closing of the valve element 18. While the valve element 18 may be of any suitable type of valve element, the element 18 may be as more fully described in U.S. Pat. No. 4,926,945.

Coil spring means 26 (FIG. 1B and 1C) acts between a shoulder 28 on the housing 12 and a shoulder 30 on the flow tube 24 to yieldably urge the flow tube 24 downwardly in a direction to engage and move the valve element 18 to an open position. When the flow tube 24 is moved upwardly, the flapper valve element 18 is freed for closure. A spring 32 forces the flapper 18 to swing upwardly and engage the valve seat 22.

A choke bean 36 is provided in the bore 16 releasably connected to the interior of the flow tube 24. The choke bean 36 has an internal diameter 38 which creates a differential pressure across the bean 36. The differential pressure acting across the bean 36 tends to move it upwardly against the force of the spring 26.

The choke bean 36 is releasably connected to the interior of the flow tube 24 by any suitable releasable connecting means such as a conventional Camco C-lock. Thus, the choke bean 36 may be replaced for changing the size of the choke bean 36 whereby the valve 10 can be adjusted to close at different well production flow rates.

The conventional C-lock may include a lock housing 50 through which locking dogs 52 may extend when driven out by wedge member 54 for locking the choke bean 36 in a recess 56 in the interior of the flow tube 24. Initially, the wedge member 54 is positioned upwardly of the locking dogs 52 so that the dogs are retracted within the housing 56 and the wedge member 54 is held upwardly relative to the housing 50 by shear dogs 58 which are initially positioned within notch 60. When the lock housing 50 is moved into the interior of the flow tube 50, it encounters a no go shoulder 62 on the flow tube 24 shearing a shear pin 64 allowing the wedge member 54 to move downwardly until the shear dogs 58 move into a recess 66 and release the wedge member 54. This allows the wedge member 54 to drive the locking dogs 52 into the recess 56. Ratchet member 68 prevents upward movement of the wedge member 54 relative to the lock housing 50.

The above description of an orifice or velocity valve is qenerally known. However, the choke bean 36, particularly since it is a wireline replaceable bean requires a large diameter. This larger area subsequently requires larger restraining forces by a spring to keep the valve open during normal flow conditions. The magnitude of the required forces cannot be conveniently provided by the coil compression spring 26 commonly used in orifice type valves. The present invention is directed to providing a spring-loaded releasable latch which will provide the large restraining force required for preventing the flow tube from moving to the closed position until desired. Referring now to FIG. 1B, the spring-loaded releasable latch means of the present invention is generally indicated by the reference numeral 70 and provides a mechanism which will retain the flow tube in an open position by providing a large restraining force required to keep the valve oPen during normal flow conditions, but which releases the flow tube upon a predetermined rate of flow through the bean 36.

The spring-loaded releasable latch 70 includes a collet sleeve 72 having a collet head 74 which can engage a groove 76 in the exterior of the flow tube 24 for restraining upward movement of the flow tube 24. The collet head 74 may be held in the groove 76 by an adjustable longitudinally movable shoulder 78.

The collet sleeve 72 is acted upon by belleville spring washers 80. The belleville spring washers can provide the required large restraining force for overcoming the pressure force on the choke bean 36, as compared to a conventional coil spring. The spring washers 80 have a limited deflection characteristic and therefore could not be used in place of the coil spring 26 as they would not by themselves provide the required total longitudinal deflection or travel needed to close the valve 10. However, the belleville springs 80 will apply a force to the collet sleeve 72 for holding the flow tube 24 in the open position until the collet head 74 moves upwardly past the adjustable shoulder 78. This allows the head 74 to move into the space 82 and out of the groove 76 thereby freeing the flow tube 24 for movement upwardly and into a valve closing position. The adjustable shoulder 78 may be longitudinally adjustable by a rotational adjustment relative to the threads 84 in the housing 12. Therefore, the adjustable shoulder 78 may be used to preset the amount of travel that the collet head 74 must make in order to release the flow tube 24 at a predetermined force. This adjustment provides a way to accurately eliminate manufacturing sensitivities and tolerances while providing a simple method of changing settings.

The travel of the collet sleeve 72 is a function of the pressure differential induced force from the choke bean 36, and the spring rate of the belleville washers 80. When released, the collet head 74 will remain out of the way until the pressure differential approaches zero.

In use, with the valve 10 shown in the open position, in the event that the flow rate increases, the flow tube 24 will move upwardly overcoming the spring 26 until the shoulder 77 in the groove 76 contacts the collet head 74. In order for the valve 10 to close, the differential force on the choke bean 36 must be such that the shoulder 77 engages and moves the collet head 74 past the shoulder 78 thereby releasing the collet head 74 from the groove 76.

In order to reset the valve 10 to the open position once flow stops and pressure across the flapper 18 is equalized, the coil compression spring 26 will push the flow tube 24 back down and return the valve to its normal position. When the groove 76 on the flow tube is adjacent to the collet head 74, the collet sleeve 72 will snap back into position shown in FIG. 1B, and the belleville spring washers 80 will reset the release mechanism.

The present release mechanism has the advantage in that the belleville washers 80 will provide high biasing loads in a small space with a small deflection. The collet release mechanism 70 allows economical and accurate actuation and the adjustability of the shoulder 78 provides accuracy and ease in changing force settings.

The invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts, and steps of the process, will be readily apparent to those skilled in the art, and which are encompassed within the spirit of the invention and the scope of the appended claims.

What is claimed is:

1. An orifice well safety valve comprising, a housing having a bore therethrough, a valve element connected to the housing and movable between open and closed positions in the bore, a flow tube telescopically movable in the housing for controlling the movement of the valve element, coiled spring means positioned between the housing and the flow tube for yieldably moving the tube in a direction for opening the valve, a choke bean connected to the flow tube, releasable latch means in the housing releasably engaging the flow tube, belleville spring means biasing the latch means in a direction yieldably opposing the movement of the tube in a direction for closing the valve, said belleville spring remaining out of engagement with the flow tube.

2. The apparatus of claim 1 including, adjustment means for adjusting the force of the belleville spring acting on the latch.

3. The apparatus of claim 1 wherein the releasable latch includes a collet.

4. The apparatus of claim 1 wherein the releasable latch includes, a groove in the exterior of the flow tube, a collet movable into and out of the groove, said collet biased into the groove by the belleville spring, and a shoulder in the housing for releasably holding the collet in the groove when the valve is in the open position whereby the belleville spring acts to hold the valve in the open position.

5. The apparatus of claim 4 wherein the position of the shoulder is longitudinally adjustable for determining the release of the collet.

* * * * *